US006539636B1

(12) United States Patent
Jennings

(10) Patent No.: US 6,539,636 B1
(45) Date of Patent: Apr. 1, 2003

(54) GARMENT PATTERN SIZING TEMPLATE SYSTEM

(76) Inventor: Ken Jennings, 12434 Bristol Commons Cir., Tampa, FL (US) 33626

( * ) Notice: Subject to any disclaimer, the term of this patent is extended or adjusted under 35 U.S.C. 154(b) by 0 days.

(21) Appl. No.: 10/029,075

(22) Filed: Dec. 21, 2001

(51) Int. Cl.[7] ..... A41H 1/00
(52) U.S. Cl. ..... 33/11; 33/563
(58) Field of Search ..... 33/1 G, 11, 12, 33/13, 562, 563

(56) References Cited

U.S. PATENT DOCUMENTS 126,825 A * 5/1872 Millwee ..... 33/13
155,322 A * 9/1874 Lemley ..... 33/12
185,842 A * 1/1877 Subera ..... 33/12
325,216 A * 8/1885 Northen ..... 33/13
325,358 A * 9/1885 Olson ..... 33/13
451,247 A * 4/1891 Kennedy ..... 33/11
453,923 A * 6/1891 Stevenson ..... 33/13
568,263 A * 9/1896 Moccia ..... 33/11
995,081 A * 6/1911 O'Brien ..... 33/11
1,552,672 A * 9/1925 Bernardo ..... 33/13
3,061,946 A * 11/1962 Carty ..... 33/563
4,860,900 A * 8/1989 Forschner ..... 33/12
5,444,920 A * 8/1995 Nelson ..... 33/11
6,108,918 A * 8/2000 Ye ..... 33/12

* cited by examiner

*Primary Examiner*—G. Bradley Bennett

(57) ABSTRACT

A garment pattern sizing template system comprises a sheet of transparent plastic. A plurality of radial construction lines extend from a region on the sheet at angles. A plurality of grids each have a central line with holes equally spaced along the central line and spaced lateral marking lines extending from the holes with sequential marking numbers from a lower number to a larger number with the central hole located on a radial construction line. The radial construction lines are sequentially marked with construction indicia.

5 Claims, 10 Drawing Sheets

GARMENT PATTERN SIZING TEMPLATE SYSTEM

BACKGROUND OF THE INVENTION

1. Field of the Invention

The present invention relates to a garment pattern sizing template system and more particularly pertains to increasing and/or decreasing the size of garment patterns in a simplified manner.

2. Description of the Prior Art

The use of pattern sizing tools of known designs and configurations is known in the prior art. More specifically, pattern sizing tools of known designs and configurations previously devised and utilized for the purpose of increasing or decreasing the size of garment patterns through known methods and apparatuses are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 1,214,296 to Gorton discloses an instrument for drafting patterns for garments. U.S. Pat. No. 4,672,748 to Perazzolo discloses a pair of tailoring set-squares for sketching the component parts of clothing especially for constructing garments of any size or model. U.S. Pat. No. 5,444,920 to Nelson discloses tools for use in dressmaking. Lastly, U.S. Pat. No. 5,570,533 to Vouyouka discloses an industrial pattern grading template.

While these devices fulfill their respective, particular objectives and requirements., the aforementioned patents do not describe a garment pattern sizing template system that allows increasing and/or decreasing the size of garment patterns in a simplified manner.

In this respect, the garment pattern sizing template system according to the present invention substantially departs from the conventional concepts and designs of the prior art, and in doing so provides an apparatus primarily developed for the purpose of increasing and/or decreasing the size of garment patterns in a simplified manner.

Therefore, it can be appreciated that there exists a continuing need for a new and improved garment pattern sizing template system which can be used for increasing and/or decreasing the size of garment patterns in a simplified manner. In this regard, the present invention substantially fulfills this need.

SUMMARY OF THE INVENTION

In view of the foregoing disadvantages inherent in the known types of pattern sizing tools of known designs and configurations now present in the prior art, the present invention provides an improved garment pattern sizing template system. As such, the general purpose of the present invention, which will be described subsequently in greater detail, is to provide a new and improved garment pattern sizing template system which has all the advantages of the prior art and none of the disadvantages.

To attain this, the present invention essentially comprises a sheet of transparent plastic having limited flexibility. The sheet is in a circular configuration with a diameter of about 11 inches. The sheet has a center point with an aperture and a periphery. A plurality of radial construction lines extend from about the center point to about the periphery. A plurality of grids each have a center line with nine holes equally spaced along the center line for marking a pattern piece there beneath. Nine spaced lateral marking lines extend in alternating points from the holes with sequential marking numbers from a smaller number of size 6 to a larger number of size 14. A central hole is located on a radial construction line. A plurality of parenthetical primary positioning numbers on the sheet are located adjacent to the grids. A plurality of paper patterns each with a plurality of circled secondary positioning numbers correlate to the primary positioning numbers on the sheet for assisting a user in the proper positioning of the sheet on a pattern during operation and use. The radial construction lines include: a first line marked "(2) back neck point" with an angled grid having the smaller number closer to the periphery and "(1) center back neck" with a transverse grid; a second line marked "(4)*a* back waist & bottom" with a radial grid having the smaller number closer to the periphery and "(3)*a* back & side panel shoulder" with an angled grid having the smaller number closer to the periphery; a third line marked "(6) back sleeve balance notch" with an angled grid having the smaller number closer to the periphery and "(5) back shoulder end" with an angled grid having the smaller number closer to the periphery; a fourth line marked "(8) back waist & bottom" with a radial grid having the smaller number closer to the periphery and "(7) back top of side seam" with an angled grid having the smaller number closer to the periphery; a fifth line marked "(9) under arm seam top", "(9)*a* under arm seam waist" and "(9)*b* underarm seam bottom" with a radial grid having the smaller number closer to the periphery; a sixth line marked "front s/p (12) waist" and "(12)*a* bottom" with a radial grid having the smaller number closer to the periphery and "(11) front s/p shoulder" with an angled grid having the smaller number closer to the periphery and "(10) front s/p shoulder end" with a transverse grid; a seventh line marked "(14) front waist" and "(14)*a* front bottom" with a radial grid having the smaller number closer to the periphery and "(13) front mid shoulder" with an angled grid having the smaller number closer to the periphery; an eighth line marked "(16) lapel break @ neck " with an angled grid having the smaller number closer to the periphery and "(15) front neck point" with an angled grid having the smaller number closer to the periphery; a ninth line marked "(18) front bottom of lapel" with an angled grid having the smaller number closer to the periphery and "(17) lapel @ collar notch" with an angled grid having the smaller number adjacent to the periphery; a tenth line marked "(19) front bottom" with a radial grid having the smaller number closer to the periphery; an eleventh line marked "(22) cuff t/sl" and "(22)*a* cuff u/sl" with a radial grid with a larger number closer to the periphery and "(21) sleeve head crown" with an angled grid having the larger number closer to the periphery and "(20) hind arm top & (20)*a* under sleeve" with an angled grid having the larger number closer to the periphery; a twelfth line marked "(23) collar step end left" with an angled grid having the smaller number closer to the periphery and "(24) collar step end right" with an angled grid having the larger number closer to the periphery; a thirteenth line marked "(25) collar lapel break notch left" with a radial grid having the smaller number closer to the periphery and "(25)*a* lapel break notch right" with a radial grid having the larger number adjacent to the periphery; and a fourteenth line marked "(26) collar neck point notch left" with a radial grid having the larger number closer to the periphery and "(26)*a* collar neck point notch right" with a radial grid having the larger number adjacent to the periphery.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved garment pattern sizing template system which has all of the advantages of the prior art pattern sizing tools of known designs and configurations and none of the disadvantages.

It is another object of the present invention to provide a new and improved garment pattern sizing template system which may be easily and efficiently manufactured and marketed.

It is further object of the present invention to provide a new and improved garment pattern sizing template system which is of durable and reliable constructions.

An even further object of the present invention is to provide a new and improved garment pattern sizing template system which is susceptible of a low cost of manufacture with regard to both materials and labor, and which accordingly is then susceptible of low prices of sale to the consuming public, thereby making such garment pattern sizing template system economically available to the buying public.

Even still another object of the present invention is to provide a garment pattern sizing template system for increasing and/or decreasing the size of garment patterns in a simplified manner.

Lastly, it is an object of the present invention to provide a new and improved garment pattern sizing template system comprising a sheet of transparent plastic. A plurality of radial construction lines extend from a region on the sheet at angles. A plurality of grids each have a central line with holes equally spaced along the central line and spaced lateral marking lines extend from the holes with sequential marking numbers from a lower number to a larger number with the central hole being located on a radial construction line. The radial construction lines from the second corner are sequentially marked with construction indicia.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIGS. 7A and 7B are the patterns of an under collar, an under sleeve and a top sleeve with a horizontal construction line there through.

The same reference numerals refer to the same parts throughout the various Figures.

DESCRIPTION OF THE PREFERRED EMBODIMENT

Figure 1A:
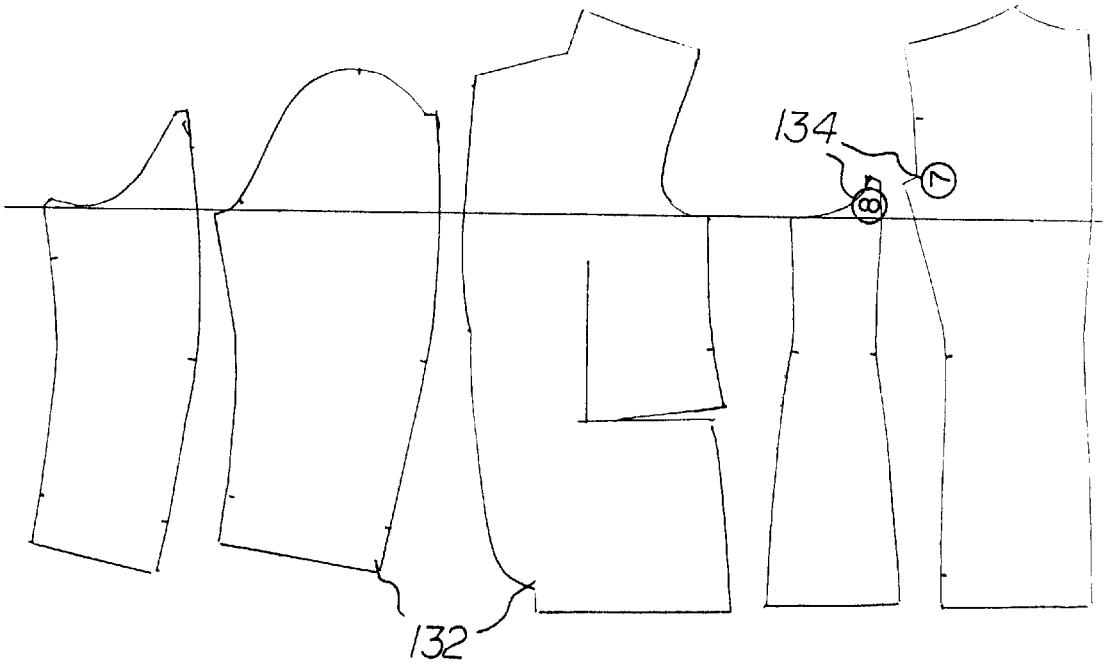
FIG. 1A is a plan view of pattern pieces for a 5-piece jacket with a horizontal construction line.
Figure 1B:
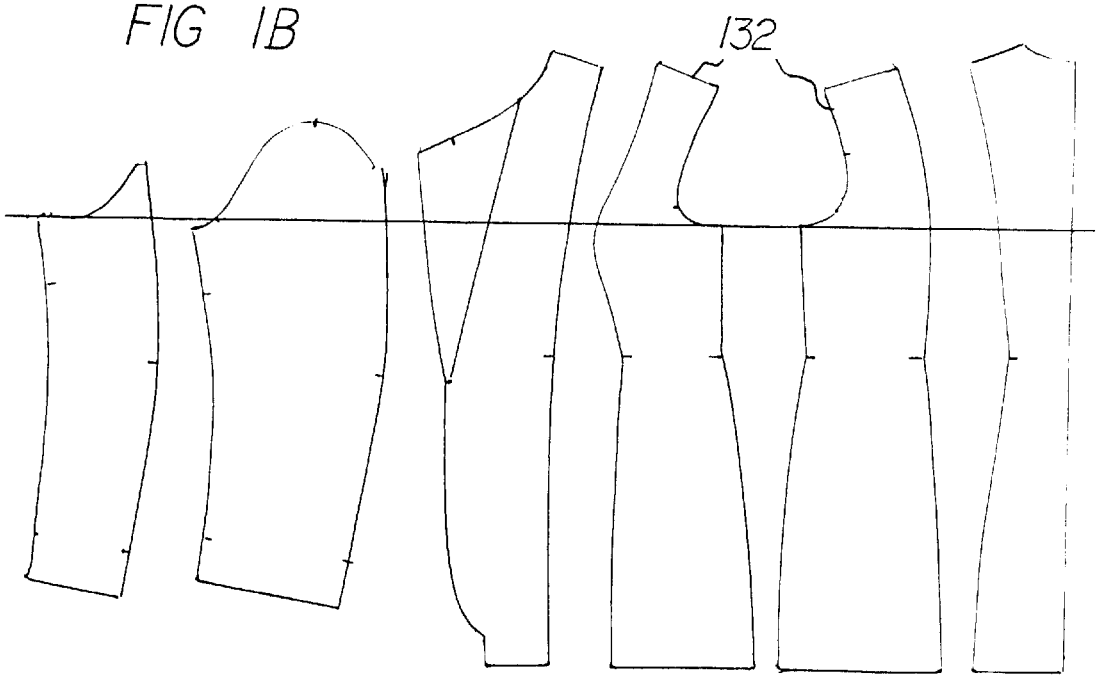
FIG. 1B is a plan view of pattern pieces for a 6-piece jacket with a horizontal construction line.

With reference now to the drawings, and in particular to FIG. 1 thereof, the preferred embodiment of the new and improved garment pattern sizing template system embodying the principles and concepts of the present invention and generally designated by the reference numeral 10 will be described.

The present invention, the garment pattern sizing template system 100 is comprised of a plurality of components. Such components in their broadest context include a sheet of transparent plastic, a plurality of radial construction lines, and a plurality of grids. Such components are individually configured and correlated with respect to each other so as to attain the desired objective.

First provided is a sheet 104 of transparent plastic having limited flexibility. The sheet is in a circular configuration with a diameter of about 11 inches. The sheet has a center point with an aperture 106 and a periphery 108.

A plurality of radial construction lines 112 extend from about the center point to about the periphery.

A plurality of grids 114, 116, 118 each have a center line 120 with nine holes 122 equally spaced along the center line for marking a pattern piece there beneath. Nine spaced lateral marking lines 124 extend in alternating points from the holes with sequential marking numbers from a smaller number of size 6 to a larger number of size 14. A central hole is located on a radial construction line.

A plurality of parenthetical primary positioning numbers 128 on the sheet are located adjacent to the grids.

A plurality of paper patterns 132 each with a plurality of circled secondary positioning numbers 134 correlate to the primary positioning numbers on the sheet for assisting a user in the proper positioning of the sheet on a pattern during operation and use.

The radial construction lines include:

a first line marked "(2) back neck point" with an angled grid having the smaller number closer to the periphery and "(1) center back neck" with a transverse grid 114;

a second line marked "(4)*a* back waist & bottom" with a radial grid having the smaller number closer to the periphery and "(3)*a* back & side panel shoulder" with an angled grid 116 having the smaller number closer to the periphery;

a third line marked "(6) back sleeve balance notch" with an angled grid having the smaller number closer to the periphery and "(5) back shoulder end" with an angled grid having the smaller number closer to the periphery;

a fourth line marked "(8) back waist & bottom" with a radial grid 118 having the smaller number closer to the periphery and "(7) back top of side seam" with an angled grid having the smaller number closer to the periphery;

a fifth line marked "(9) under arm seam top", "(9)*a* under arm seam waist" and "(9)*b* underarm seam bottom" with a radial grid having the smaller number closer to the periphery;

a sixth line marked "front s/p (12) waist" and "(12)*a* bottom" with a radial grid having the smaller number closer to the periphery and "(11) front s/p shoulder" with an angled grid having the smaller number closer to the periphery and "(10) front s/p shoulder end" with a transverse grid;

a seventh line marked "(14) front waist" and "(14)*a* front bottom" with a radial grid having the smaller number closer to the periphery and "(13) front mid shoulder" with an angled grid having the smaller number closer to the periphery;

an eighth line marked "(16) lapel break @ neck " with an angled grid having the smaller number closer to the periphery and "(15) front neck point" with an angled grid having the smaller number closer to the periphery;

a ninth line marked "(18) front bottom of lapel" with an angled grid having the smaller number closer to the periphery and "(17) lapel @ collar notch" with an angled grid having the smaller number adjacent to the periphery;

a tenth line marked "(19) front bottom" with a radial grid having the smaller number closer to the periphery;

an eleventh line marked "(22) cuff t/sl" and "(22)*a* cuff u/sl" with a radial grid with a larger number closer to the periphery and "(21) sleeve head crown" with an angled grid having the larger number closer to the periphery and "(20) hind arm top & (20)*a* under sleeve" with an angled grid having the larger number closer to the periphery;

a twelfth line marked "(23) collar step end left" with an angled grid having the smaller number closer to the periphery and "(24) collar step end right" with an angled grid having the larger number closer to the periphery;

a thirteenth line marked "(25) collar lapel break notch left" with a radial grid having the smaller number closer to the periphery and "(25)*a* lapel break notch right" with a radial grid having the larger number adjacent to the periphery; and a fourteenth line marked "(26) collar neck point notch left" with a radial grid having the larger number closer to the periphery and "(26)*a* collar neck point notch right" with a radial grid having the larger number adjacent to the periphery.

Figure 10:
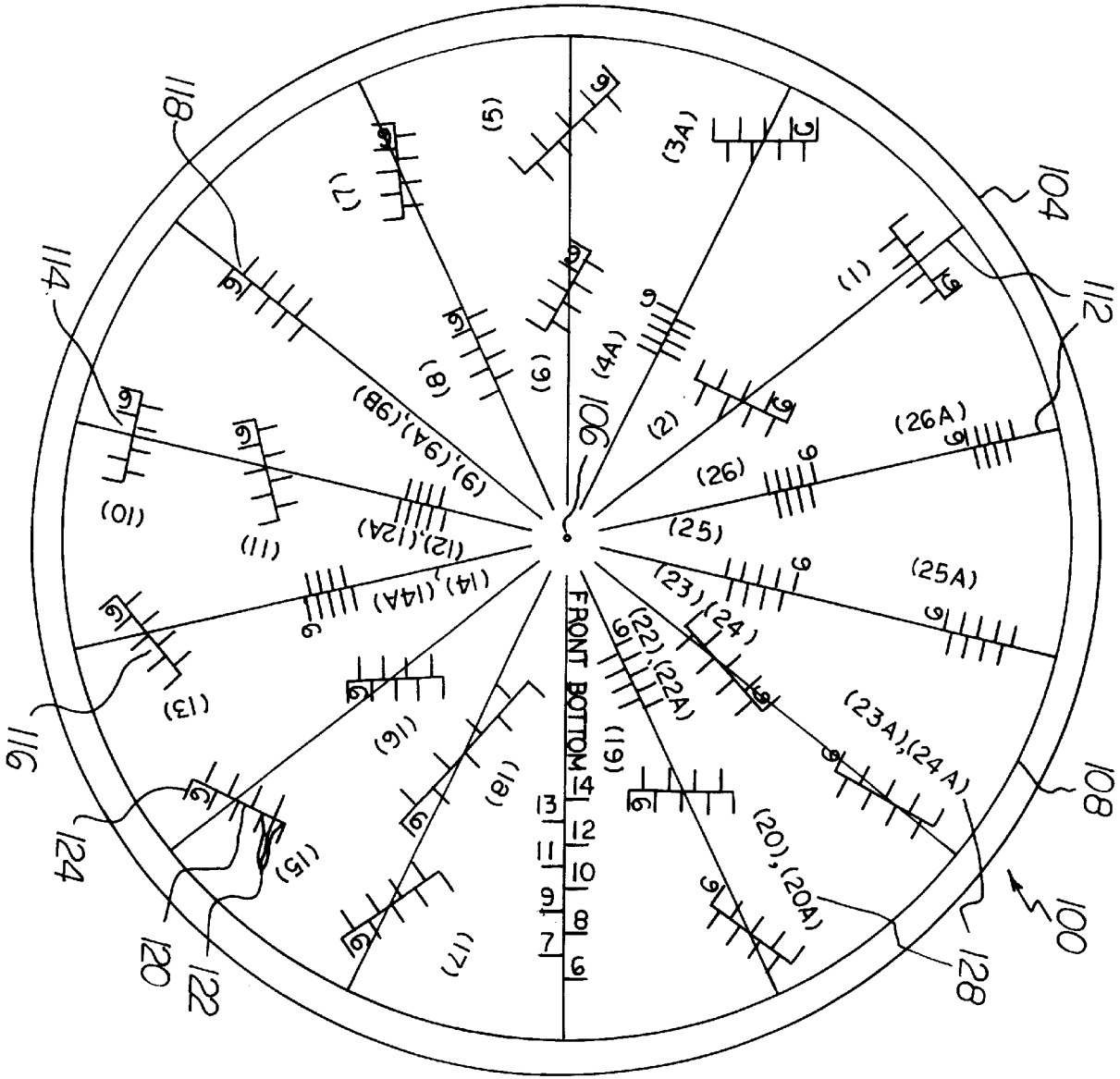
FIG. 10 is a plan view of the template of the present invention.

FIGS. 1–9 illustrate various pattern pieces, normally of thin paper, used in the fabrication of garments from sections. Such pattern pieces are in various states of preparation, some without lines or markings, others with lines and/or markings created through the use of the template shown in FIG. 10. Other types of templates could readily be fabricated and utilized as a function of the sizes and/or designs of the intended garments. The circles numbers on the pattern pieces are utilized in placing the pattern pieces in proper positions, one with respect to the other, whereby the fabric garment sections created through the use of pattern pieces may be properly coupled through stitching to form a final garment of an intended size.

The garment pattern sizing template system of the present invention is comprised of sets of templates used for increasing and/or decreasing the size of a garment pattern for men's, women's and children's inner wear and outerwear, jackets, pants, skirts, coats and dresses and all their component parts within the normal accepted industry standards.

The system consists of sets of flat transparent templates upon which are drawn a series of lines, angles, gradations, and holes which, when applied to the relevant grading points of a pattern, will control and maintain the integrity of the original design and silhouette throughout a range of sizes.

The United States industry standard is two inches per size, e.g. 10–12. The system is designed to increase or decrease in one-inch increments that allows for the selection of in-between, odd number, sizes as well as regular, even number, sizes. For example, increasing/decreasing by one, three or five inches allows for odd-numbered sizes. Carefully, following the instructions also allows for increase and/or decreasing different parts of the body independent of each other. For example, the hip could be increased by three inches while the bust is only increased by one inch. A metric version is also available for foreign markets.

The following instructions for use are for the most popular styles with 3 or 4 panels. See FIG. 1. The system, however, can be used for most jacket and coat styles.

The pattern in the Ladies 4-Panel Jacket example is size 10.

Figure 2:
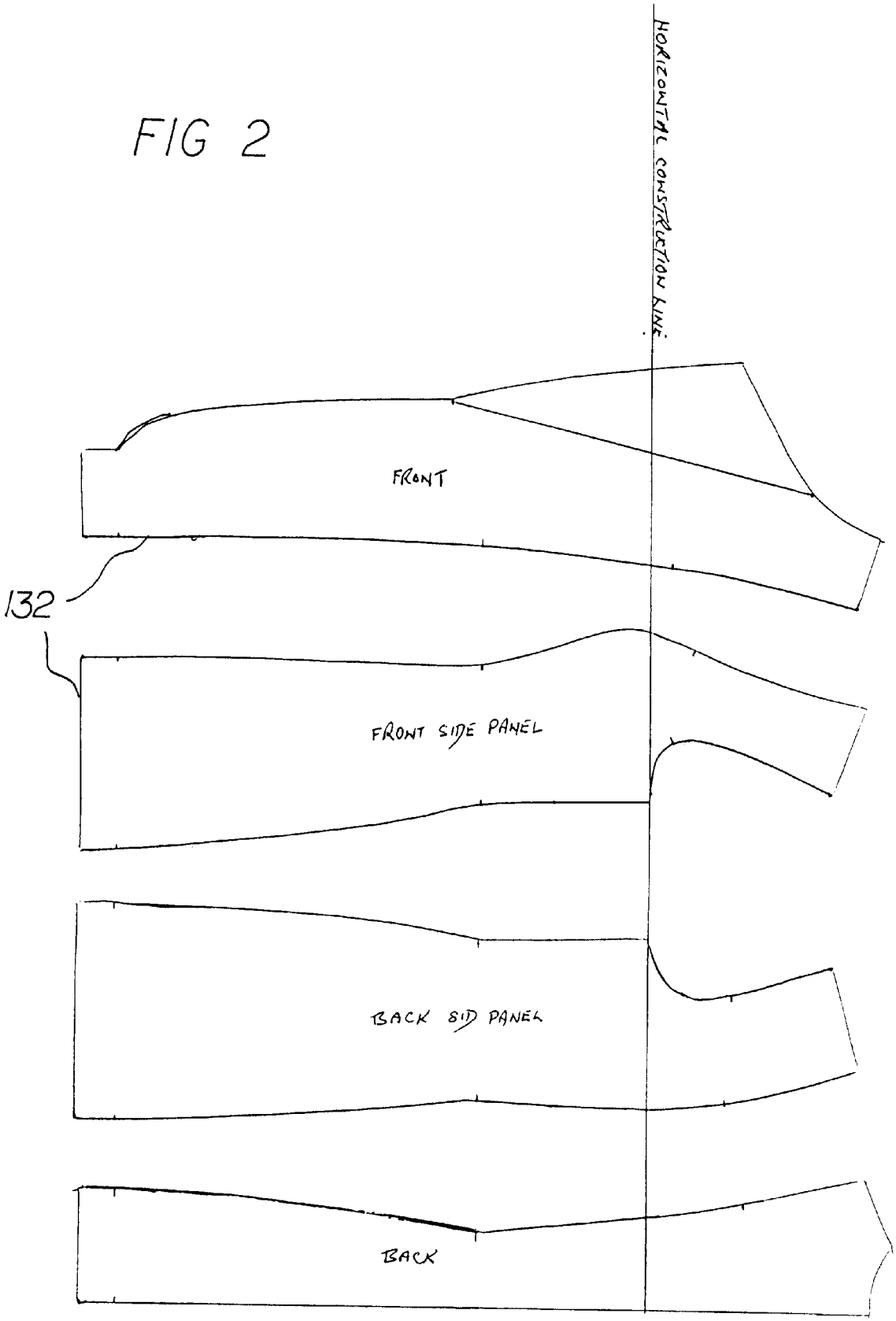
FIG. 2 is a pattern of the jacket portions of the 6-piece pattern shown in FIG. 1B.
Figure 3:
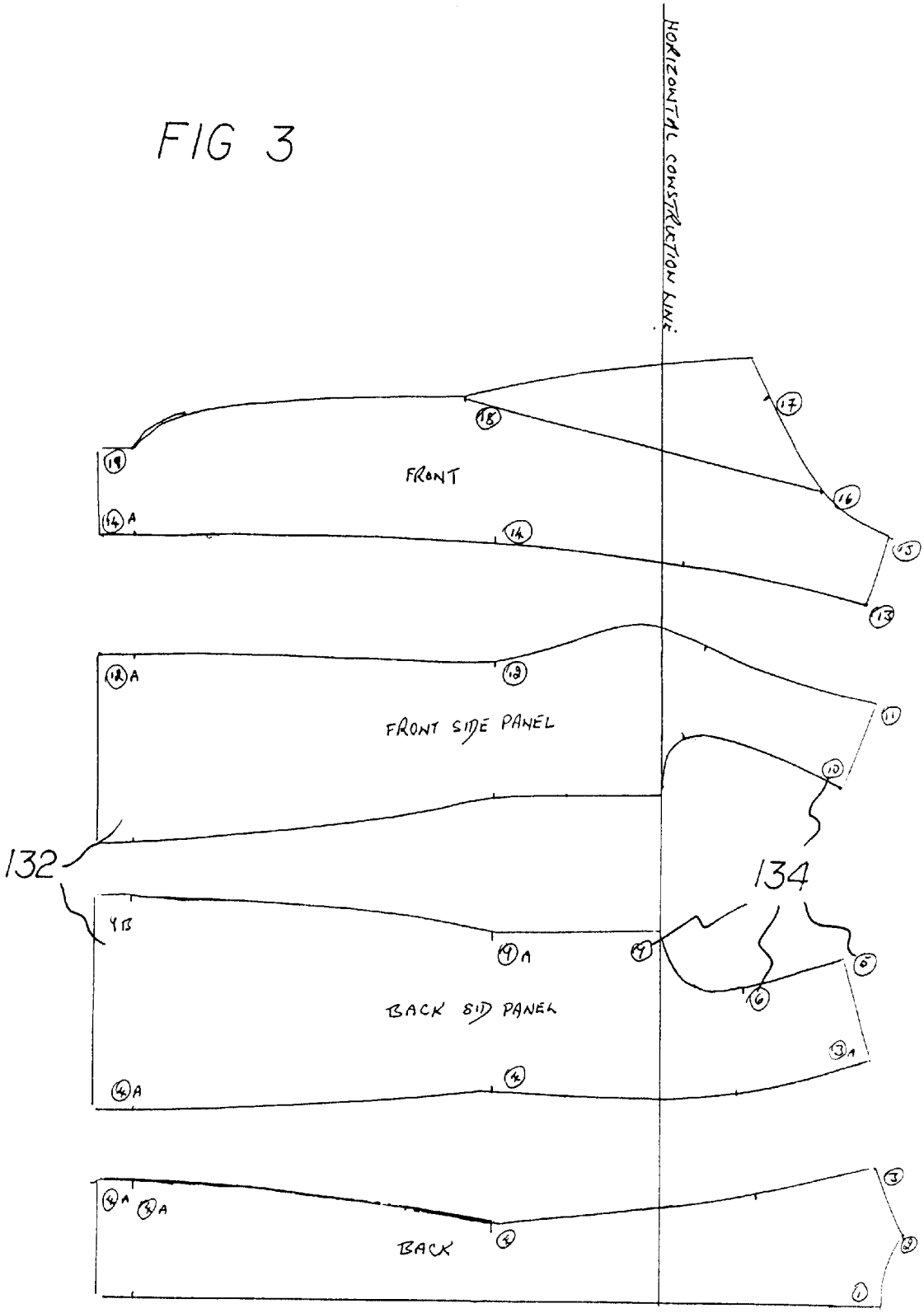
FIG. 3 is the pattern of FIG. 2 but with guide markings added.
Figure 4:
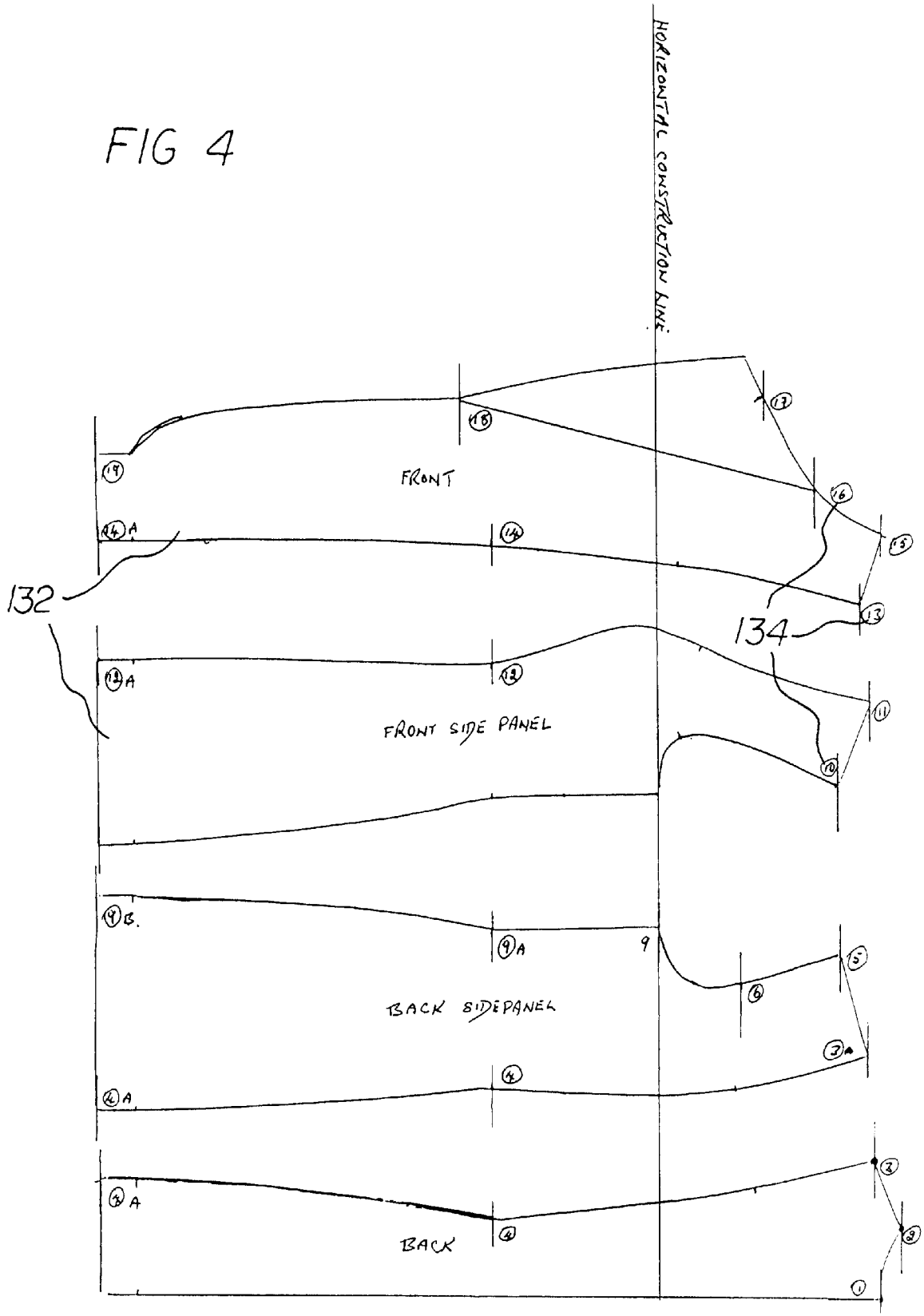
FIG. 4 is a showing similar to FIGS. 2 and 3 but showing the guide markings and supplemental change markings necessary for the utilization of the template of FIG. 10.

Step 1: Lay the pattern to be graded on paper as indicated in FIG. 2, with the center back towards you and arranged along a horizontal construction line at base of armhole, so that all components are balanced. Be sure to leave enough space between panels to allow for any increase in size. Copy pattern onto paper.

Step 2: Number the grading points as follows. See FIG. 3.

Back

(1) Center back neck
(2) Back neck point
(3) Back shoulder
(4) Back waist
(4*a*) Back bottom
(4*a*) Back side panel bottom
(4*a*) Back side panel waist
(3*a*) Back side panel shoulder
(5) Back side panel shoulder end (6) Back sleeve balance notch
(7) Back top of side seam
(8) Back wst & bottom
(9) Under arm seam top
(9*a*) Under arm waist
(9*b*) Under arm bottom
Front
(10) Front side panel shoulder end
(11) Front side panel shoulder
(12) Front side panel waist
(12*a*) Front side panel bottom
(13) Front mid shoulder
(14) Front waist
(14*a*) Front bottom
(15) Front neck point
(16) Lapel break at neck
(17) Lapel at collar notch
(18) Front top button or lapel length
(19) Front bottom Step 3: Draw a short parallel line from each grading point, extending equally in both directions, parallel to the construction line. See FIG. 4.

Step 4: Starting at the center back neck (1) place the template line (1) exactly over the parallel line and locate the intersect point with the master size (10 in this example) center back neck.

Step 4A: Using a pen vice or similar tool, pick off the size or sizes you wish to create.

Repeat the process for (2) neck point. Note the angle that controls the increase/decrease in the width or the neck.

Repeat for (3), (4) and (4*a*). Note the angle that controls the increase/decrease in the width of the side panel, shoulders and shoulder end.

Step 5: Complete the resizing of the back by connecting all the new picked off points using the master pattern or a French curve. It is strongly recommended that the master pattern be used to ensure faithful reproduction of the original design.

Figure 5A:
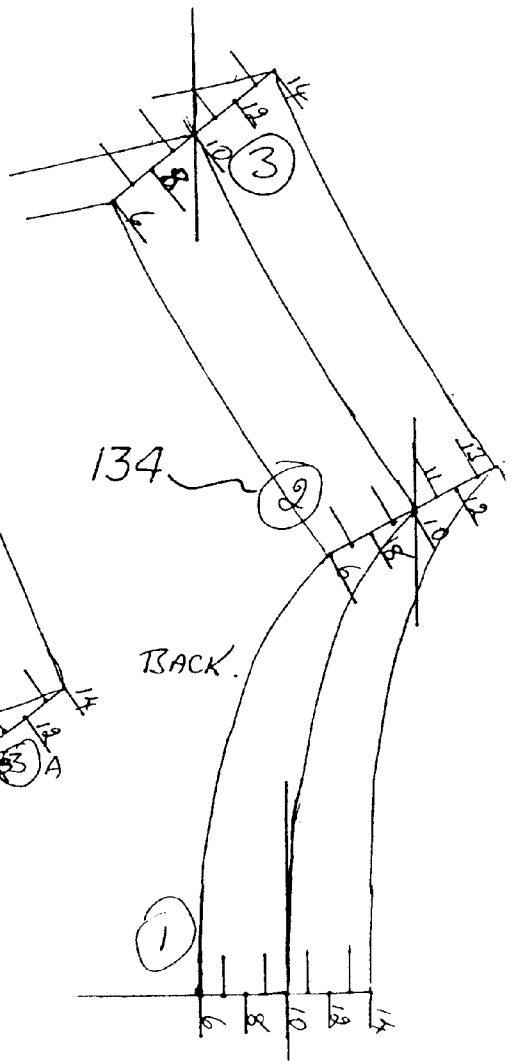
FIGS. 5A and 5B are enlarged showings of the back side panel and the back panel of FIG. 4 but illustrating the template overlying the pattern.
Figure 5B:
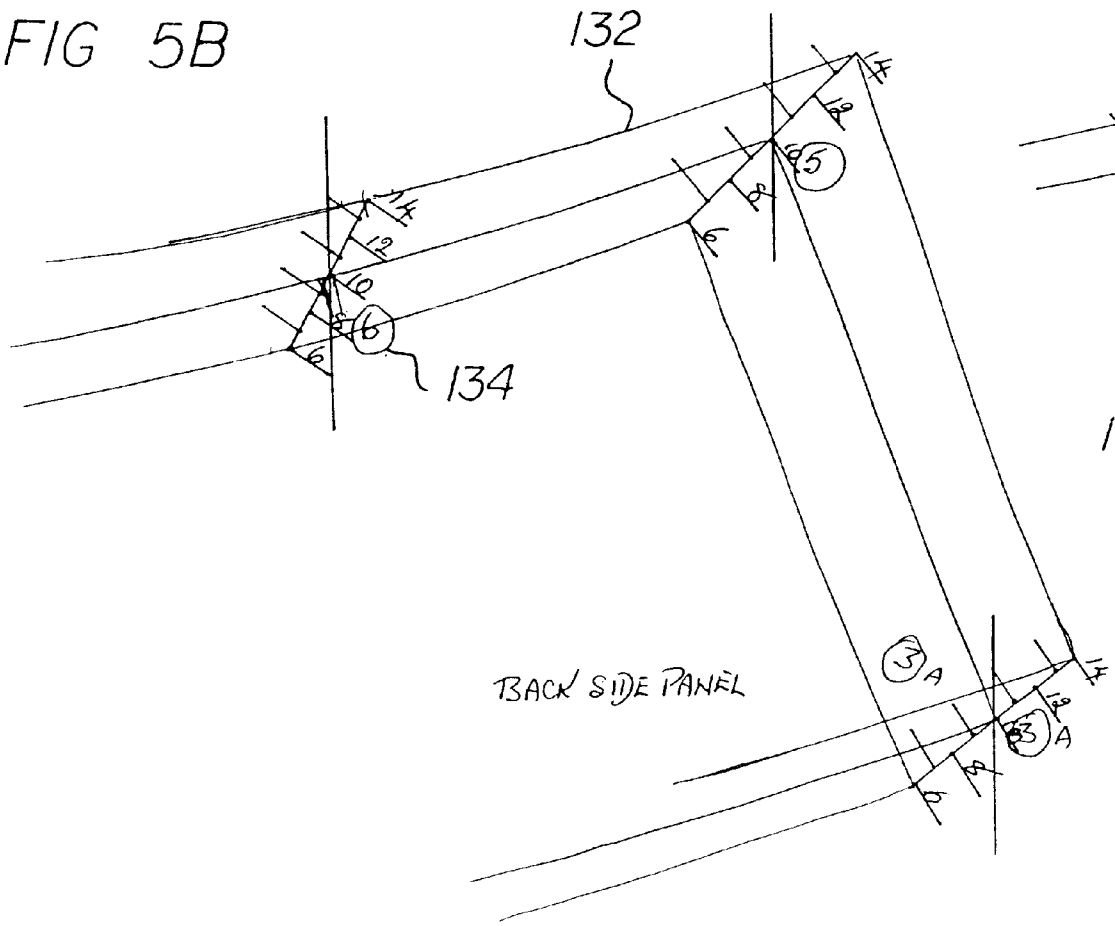
Figure 6:
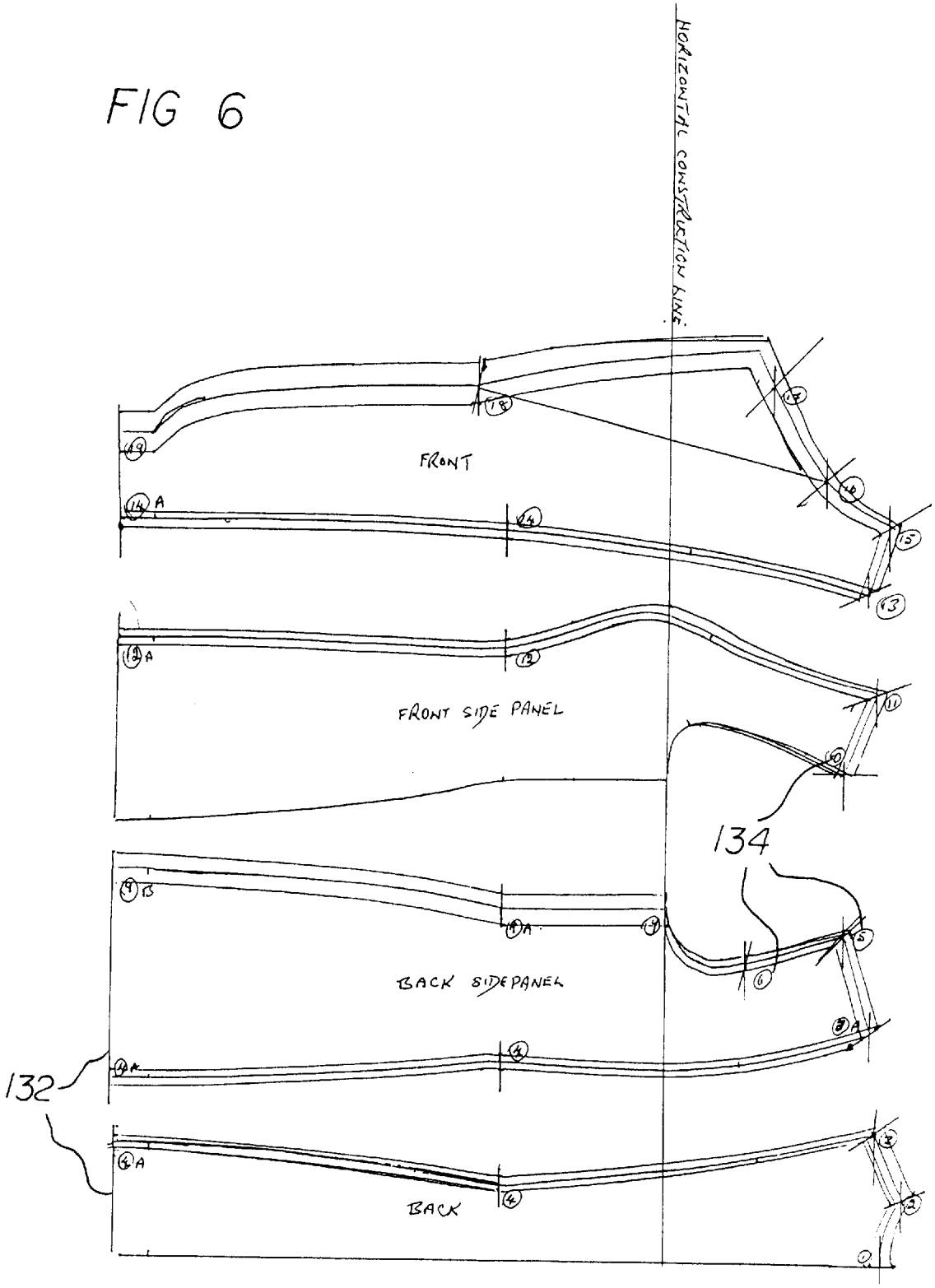
FIG. 6 is an illustration similar to that of FIGS. 2 through 5B illustrating the full four patterns with the template markings in anticipation of cutting and utilization.

See FIGS. 5A and 5B and FIG. 6 to check that the redrawn pattern looks the same as in the illustration.

Continue the process in sequence through (19). Note the grading points (5) and (6) are followed by (9), (9*a*) and (9*b*). This occurs because (7) and (8) are for the 3-panel jacket. See FIG. 1.

When all the points have been picked off, complete the process by connecting the points and re-drawing the new size/sizes using the master pattern. See FIG. 6.

Sleeve

Figure 7A:
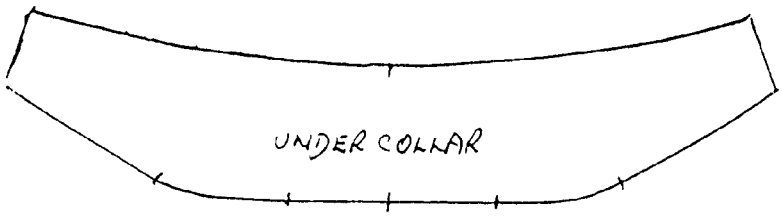
Figure 7B:
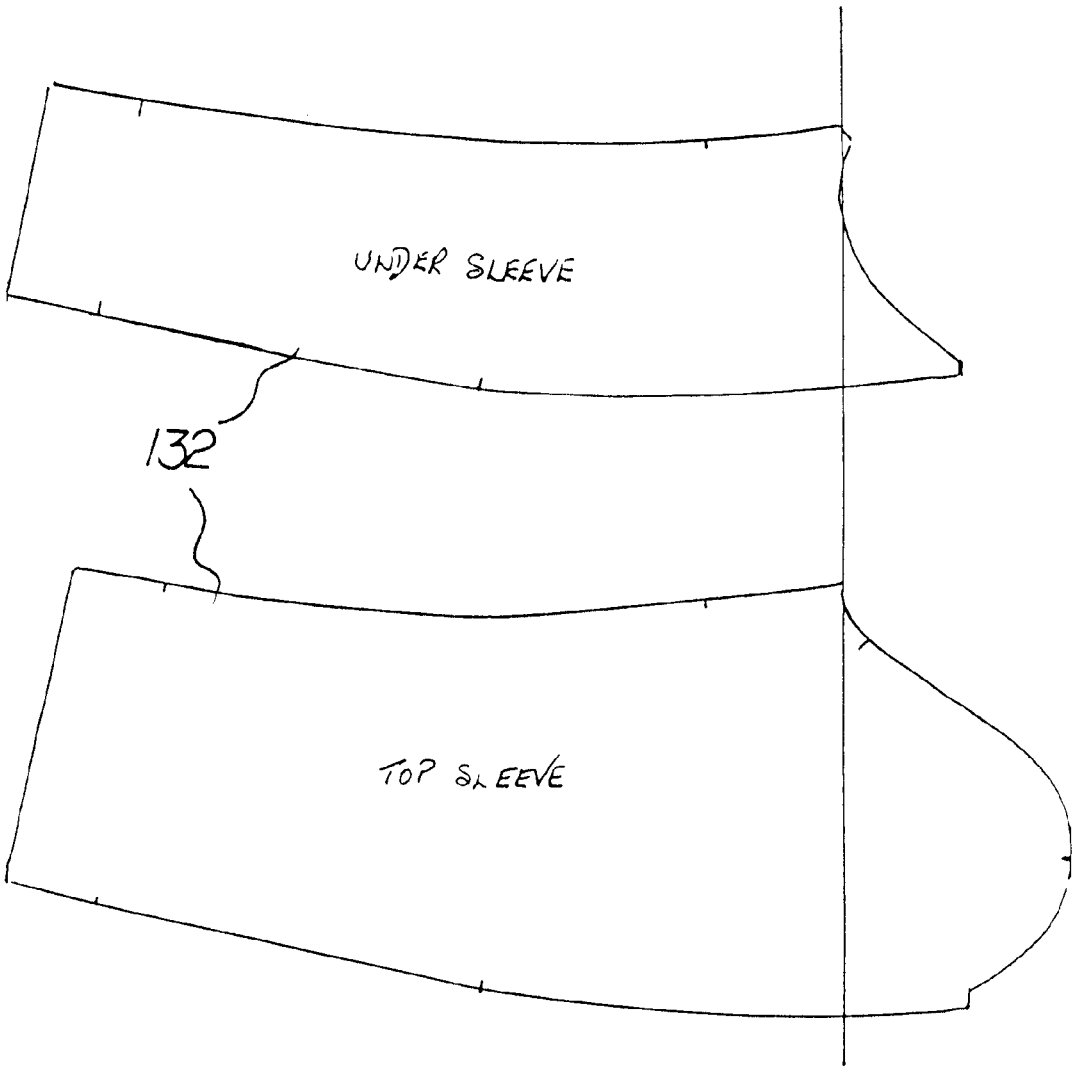
Figure 8A:
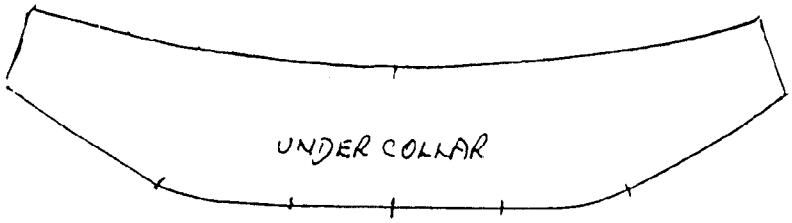
FIGS. 8A and 8B are the patterns of FIGS. 7A and 7B but with guide markings added.
Figure 8B:
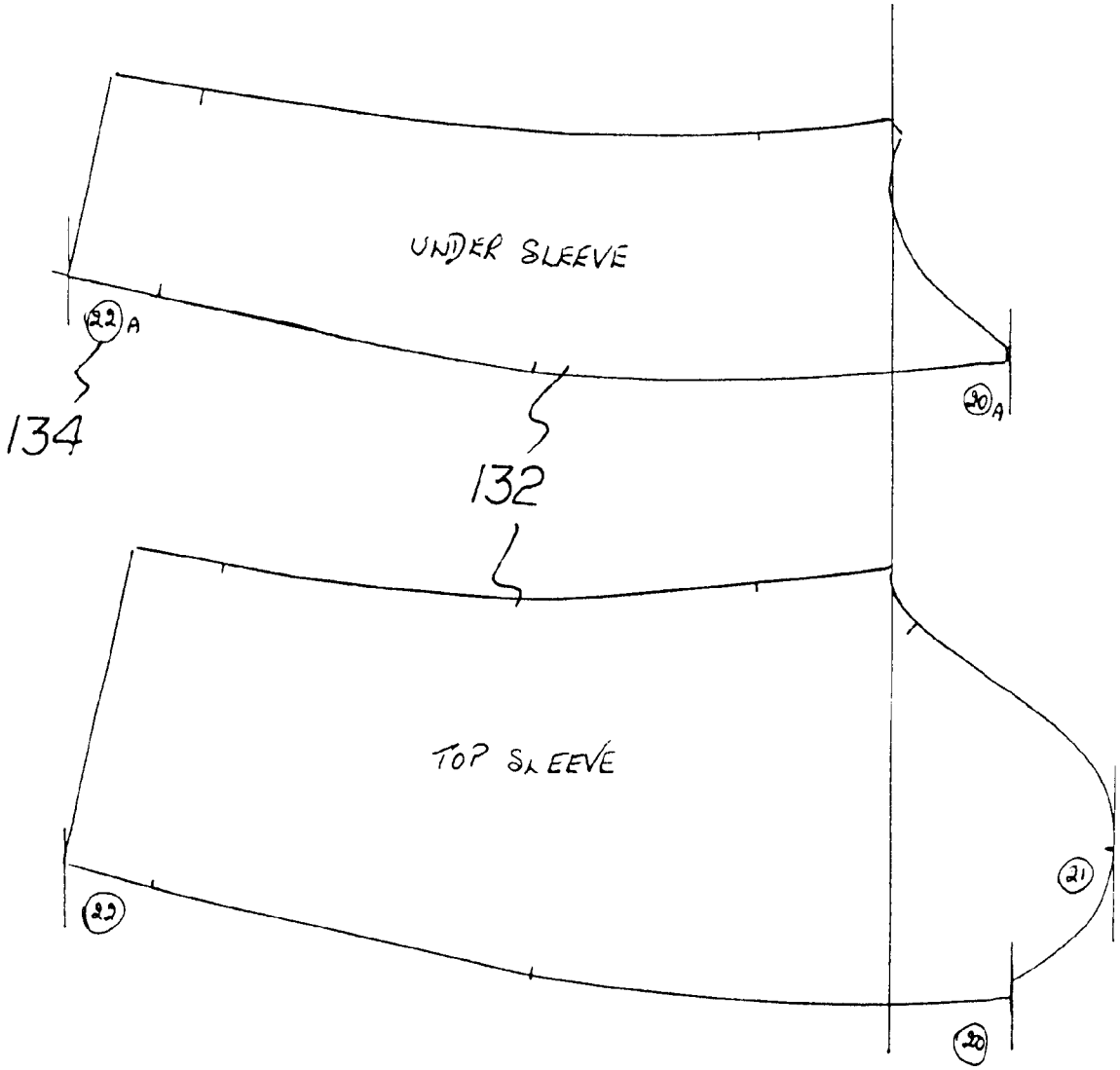
Figure 9A:
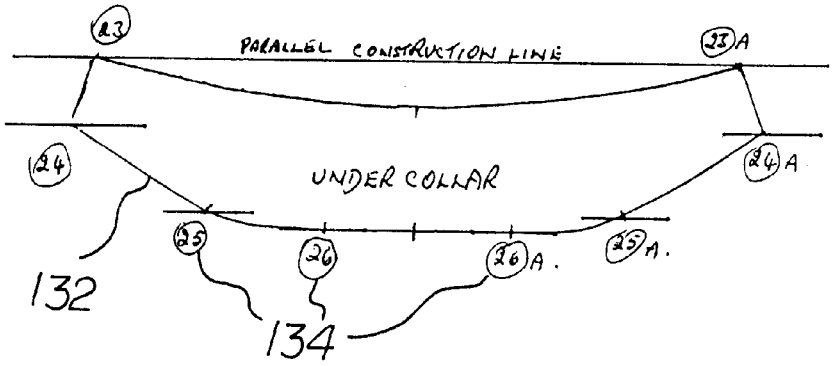
FIGS. 9A and 9B are the patterns of FIGS. 7A, 7B, 8A and 8B but illustrating he guide markings and supplemental change markings after the utilization of the template of FIG. 10.
Figure 9B:
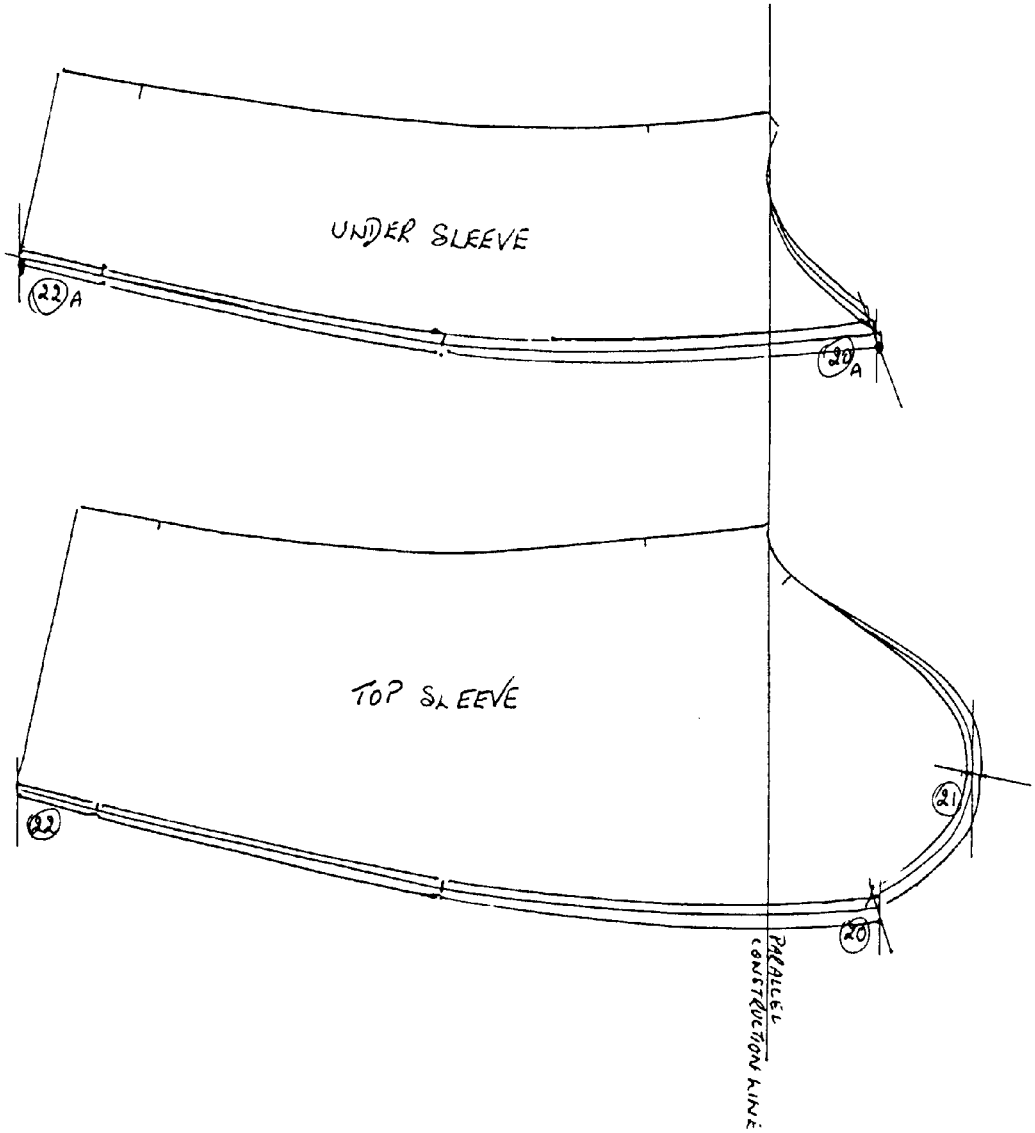

Step 1: Lay the sleeve pattern on paper as indicated in FIG. 7. Make sure to lay the pattern on a parallel construction line that matches the one through the body. See FIG. 7.

Step 2: Number the grading points as follows: See FIG. 8.
(20) Hind arm top sleeve
(20*a*) Hind arm under sleeve
(21) Sleeve head crown
(22) Cuff top sleeve
(22*a*) Cuff under sleeve Step 3: Draw short parallel lines from each grading point (20) through (22*a*) extending in both directions. See FIG. 8.

Step 4: Place the template over parallel line 20 and locate point (20) with the master size (10 in this example). Pick the size/sizes you wish to create. Continue sequentially (20*a*) through (22*a*). Using the master pattern connect all the points by re-drawing the new size/sizes. See FIG. 9.

Collar

Step 1: Copy collar pattern onto paper. See FIG. 10.

Step 2: Number the grading points as follows: See FIG. 10.
(23) Collar edge and left
(23*a*) Collar edge end right
(24) Collar step end L
(24*a*) Collar step end R
(25) Lapel break notch L
(25*a*) Lapel break notch R
(26) Neck point notch L
(26*a*) Neck point notch R Step 3: Draw a parallel construction line through points (23) and (23*a*).

Step 4: Draw short parallel lines from each grading point extending in both directions.

Step 5: Starting with the collar edge place the template over parlalel line 23 and locate point (23) with the master size (10 in this example). Pick the size/sizes you wish to create. Continue sequentially (23*a*) through (26*a*).

Step 6: Using the master pattern, connect all the points by redrawing the new size/sizes, and then check the accuracy of your sizing.

The basic components of your jacket are now complete. You can use the same method to grade all other components in your jacket, i.e. lining, interlining, etc.

Various other patterns and templates may be utilized in association with the present invention for example, the shape of the pattern, the number of construction lines, the number of grids and holes and their positioning may vary as a function of the application. The invention is equally applicable to men's and women's and children's clothing including jackets, pants, skirts, dresses, etc. By way of one alternate embodiment, the garment pattern sizing system for increasing and/or decreasing the size of garment patterns for men's regular jackets comprises a sheet of transparent plastic having limited flexibility. The sheet is in a circular configuration with a diameter of about 11 inches and has a center point with an aperture and a periphery.

In this alternate embodiment, a plurality of radial construction lines extend from about the center point to about the periphery.

Also, in this embodiment, a plurality of grids each have a center line with nine holes equally spaced along the center line for marking a pattern piece there beneath. Nine spaced lateral marking lines extend in alternating points from the holes with sequential marking numbers from a smaller number of 36 inches to a larger number of 44 inches. A central hole is located on a radial construction line.

Further, in this embodiment, a plurality of parenthetical primary positioning numbers on the sheet located adjacent to the grids.

Additionally, in this embodiment, a plurality of paper patterns are provided. Each pattern has a plurality of circled secondary positioning numbers correlated to the primary positioning numbers on the sheet. The correlated numbers assist a user in the proper positioning of the sheet on a pattern during operation and use.

In this embodiment, the radial construction lines include:

- a first line marked "(2) back neck point" with an angled grid having the smaller number closer to the periphery and "(1) center back neck" with a transverse grid;
- a second line marked "(4) back sleeve pitch" with an angled grid having the smaller number closer to the periphery and "(3) back shoulder end" with an angled grid having the smaller number closer to the periphery;
- a third line marked "(6) back waist & bottom" with a radial grid having the smaller number closer to the periphery and "(5) back top sideseam" with an angled grid having the smaller number closer to the periphery;
- a fourth line marked "(8) front waist & bottom" with a radial grid having the larger number closer to the periphery and "(7) front top sideseam" with an angled grid having the larger number closer to the periphery;

a fifth line marked "(10) front neck point" with an angled grid having the smaller number closer to the periphery and "(9) front should end" with a transverse grid;

a sixth line marked "(12) lapel @ collar notch" with an angled grid having the smaller number closer to the periphery and "(11)*a* lapel break @ neck" with an angled grid having the smaller number closer to the periphery;

a seventh line marked "(13) front bottom of lapel" with an angled grid having the smaller number closer to the periphery an eight line marked "(15)*a* front dart & pkt position" with a radial grid having the smaller number closer to the periphery and "(14) front bottom" with a radial grid having the smaller number closer to the periphery;

a ninth line marked "(18)*a* cuff width" with a radial grid having the larger number closer to the periphery and "(17) sleeve head crown" with an angled grid having the larger number closer to the periphery and "(16)*a* sleeve top hindarm" with an angled grid having the larger number closer to the periphery;

a tenth line marked "(19) collar end left" and "(20) collar step left" with an angled grid having the smaller number closer to the periphery and "(19)*a* collar end right" and "(20)*a* collar step right" with an angled grid having the larger number closer to the periphery;

an eleventh line marked "collar (21) lapel break notch left" with a radial grid having the smaller number closer to the periphery and "(21)*a* lapel break notch right" with a radial grid having the larger number adjacent to the periphery; and a twelfth line marked "(22) neck point notch left" with a radial grid having the smaller number closer to the periphery and "(22)*a* neck point notch right" with a radial grid having the larger number closer to the periphery.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A garment pattern sizing system for increasing and/or decreasing the size of garment patterns for women's ¾ panel jackets including, in combination:

a sheet of transparent plastic having limited flexibility in a circular configuration with a diameter of about 11 inches and having a center point with an aperture and a periphery;

a plurality of radial construction lines extending from about the center point to about the periphery;

a plurality of grids each having a center line with nine holes equally spaced along the center line for marking a pattern piece there beneath and nine spaced lateral marking lines extending in alternating points from the holes with sequential marking numbers from a smaller number of size 6 to a larger number of size 14 and with a central hole being located on a radial construction line;

a plurality of parenthetical primary positioning numbers on the sheet located adjacent to the grids; and a plurality of paper patterns each with a plurality of circled secondary positioning numbers correlated to the primary positioning numbers on the sheet for assisting a user in the proper positioning of the sheet on a pattern during operation and use;

the radial construction lines including:

a first line marked "(2) back neck point" with an angled grid having the smaller number closer to the periphery and "(1) center back neck" with a transverse grid;

a second line marked "(4)*a* back waist & bottom" with a radial grid having the smaller number closer to the periphery and "(3)*a* back & side panel shoulder" with an angled grid having the smaller number closer to the periphery;

a third line marked "(6) back sleeve balance notch" with an angled grid having the smaller number closer to the periphery and "(5) back shoulder end" with an angled grid having the smaller number closer to the periphery;

a fourth line marked "(8) back waist & bottom" with a radial grid having the smaller number closer to the periphery and "(7) back top of side seam" with an angled grid having the smaller number closer to the periphery;

a fifth line marked "(9) under arm seam top", "(9)*a* under arm seam waist" and "(9)*b* underarm seam bottom" with a radial grid having the smaller number closer to the periphery;

a sixth line marked "front s/p (12) waist" and "(12)*a* bottom" with a radial grid having the smaller number closer to the periphery and "(11) front s/p shoulder" with an angled grid having the smaller number closer to the periphery and "(10) front s/p shoulder end" with a transverse grid;

a seventh line marked "(14) front waist" and "(14)*a* front bottom" with a radial grid having the smaller number closer to the periphery and "(13) front mid shoulder" with an angled grid having the smaller number closer to the periphery;

an eighth line marked "(16) lapel break @ neck" with an angled grid having the smaller number closer to the periphery and "(15) front neck point" with an angled grid having the smaller number closer to the periphery;

a ninth line marked "(18) front bottom of lapel" with an angled grid having the smaller number closer to the periphery and "(17) lapel @ collar notch" with an angled grid having the smaller number adjacent to the periphery;

a tenth line marked "(19) front bottom" with a radial grid having the smaller number closer to the periphery;

an eleventh line marked "(22) cuff t/sl" and "(22)*a* cuff u/sl" with a radial grid with a larger number closer to the periphery and "(21) sleeve head crown" with an angled grid having the larger number closer to the periphery and "(20) hind arm top & (20)*a* under sleeve" with an angled grid having the larger number closer to the periphery;

a twelfth line marked "(23) collar step end left" with an angled grid having the smaller number closer to the periphery and "(24) collar step end right" with an angled grid having the larger number closer to the periphery;

a thirteenth line marked "(25) collar lapel break notch left" with a radial grid having the smaller number closer to the periphery and "(25)*a* lapel break notch right" with a radial grid having the larger number adjacent to the periphery; and a fourteenth line marked "(26) collar neck point notch left" with a radial grid having the larger number closer to the periphery and "(26)*a* collar neck point notch right" with a radial grid having the larger number adjacent to the periphery.

2. A garment pattern sizing template system including:

a sheet of transparent plastic;

a plurality of radial construction lines extending from a region on the sheet at angles; and a plurality of grids each having a central line with holes equally spaced along the central line and spaced lateral marking lines extending from the holes with sequential marking numbers from a lower number to a larger number with the central hole being located on a radial construction line, the radial construction lines being sequentially marked with construction indicia.

3. The system as set forth in claim 2 wherein the sheet is circular and the radial construction lines are essentially equally spaced radiating from the center of the sheet.

4. The system as set forth in claim 2 wherein the grids include transverse grids, angled grids and radial grids.

5. A garment pattern sizing system for increasing and/or decreasing the size of garment patterns for men's regular jackets including, in combination:

a sheet of transparent plastic having limited flexibility in a circular configuration with a diameter of about 11 inches and having a center point with an aperture and a periphery;

a plurality of radial construction lines extending from about the center point to about the periphery;

a plurality of grids each having a center line with nine holes equally spaced along the center line for marking a pattern piece there beneath and nine spaced lateral marking lines extending in alternating points from the holes with sequential marking numbers from a smaller number of 36 inches to a larger number of 44 inches and with a central hole being located on a radial construction line;

a plurality of parenthetical primary positioning numbers on the sheet located adjacent to the grids; and a plurality of paper patterns each with a plurality of circled secondary positioning numbers correlated to the primary positioning numbers on the sheet for assisting a user in the proper positioning of the sheet on a pattern during operation and use;

the radial construction lines including:

a first line marked "(2) back neck point" with an angled grid having the smaller number closer to the periphery and "(1) center back neck" with a transverse grid;

a second line marked "(4) back sleeve pitch" with an angled grid having the smaller number closer to the periphery and "(3) back shoulder end" with an angled grid having the smaller number closer to the periphery;

a third line marked "(6) back waist & bottom" with a radial grid having the smaller number closer to the periphery and "(5) back top sideseam" with an angled grid having the smaller number closer to the periphery;

a fourth line marked "(8) front waist & bottom" with a radial grid having the larger number closer to the periphery and "(7) front top sideseam" with an angled grid having the larger number closer to the periphery;

a fifth line marked "(10) front neck point" with an angled grid having the smaller number closer to the periphery and "(9) front should end" with a transverse grid;

a sixth line marked "(12) lapel @ collar notch" with an angled grid having the smaller number closer to the periphery and "(11)*a* lapel break @ neck" with an angled grid having the smaller number closer to the periphery;

a seventh line marked "(13) front bottom of lapel" with an angled grid having the smaller number closer to the periphery an eight line marked "(15)*a* front dart & pkt position" with a radial grid having the smaller number closer to the periphery and "(14) front bottom" with a radial grid having the smaller number closer to the periphery;

a ninth line marked "(18)*a* cuff width" with a radial grid having the larger number closer to the periphery and "(17) sleeve head crown" with an angled grid having the larger number closer to the periphery and "(16)*a* sleeve top hindarm" with an angled grid having the larger number closer to the periphery;

a tenth line marked "(19) collar end left" and "(20) collar step left" with an angled grid having the smaller number closer to the periphery and "(19)*a* collar end right" and "(20)*a* collar step right" with an angled grid having the larger number closer to the periphery;

an eleventh line marked "collar (21) lapel break notch left" with a radial grid having the smaller number closer to the periphery and "(21)*a* lapel break notch right" with a radial grid having the larger number adjacent to the periphery; and a twelfth line marked "(22) neck point notch left" with a radial grid having the smaller number closer to the periphery and "(22)*a* neck point notch right" with a radial grid having the larger number closer to the periphery.

* * * * *